US006834950B2

(12) United States Patent
Hügle

(10) Patent No.: US 6,834,950 B2
(45) Date of Patent: Dec. 28, 2004

(54) TACHOGRAPH COMPRISING A CUBOID HOUSING AND A PRINTING DEVICE

(75) Inventor: Axel Hügle, Furtwangen (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/630,782

(22) Filed: Jul. 31, 2003

(65) Prior Publication Data

US 2004/0021763 A1 Feb. 5, 2004

Related U.S. Application Data

(63) Continuation of application No. PCT/EP02/00433, filed on Jan. 17, 2002.

(30) Foreign Application Priority Data

Feb. 3, 2001 (DE) ..... 201 01 836 U

(51) Int. Cl.[7] ..... B41J 29/13
(52) U.S. Cl. ..... 347/108
(58) Field of Search ..... 347/108, 114, 347/171, 138, 141, 152, 154, 5, 7, 1, 9; 346/145, 136, 139 A, 118, 119, 41, 104, 134, 438

(56) References Cited

U.S. PATENT DOCUMENTS 5,533,821 A 7/1996 Awai et al.
5,637,070 A 6/1997 Sasai
6,392,677 B1 * 5/2002 Lais ..... 346/33 D
6,439,903 B1 * 8/2002 Burkart ..... 439/159

FOREIGN PATENT DOCUMENTS

DE 29720521 U1 11/1997
DE 29920901 U1 11/1999
EP 0372478 A2 12/1989
EP 1052514 A1 4/2000

OTHER PUBLICATIONS

PCT International Search Report for PCT/EP02/00433, the instant patent application.

Derwent Abstract of DE29907171–U1, associated with EP 1052514.

Derwent Abstract of DE2970521 –U1.

* cited by examiner

*Primary Examiner*—Raquel Yvette Gordon
(74) *Attorney, Agent, or Firm*—Jacob Eisenberg Siemens AG

(57) ABSTRACT

The present invention relates to a tachograph including a cuboid housing and a print device. The print device is formed in such a manner that the thermal print head in the housing of the tachograph, the transport cylinder and the mechanism actuating the cylinder are disposed in a support which can be removed from the front side of the tachograph. In addition, a support bridge is provided to support the thermal print head which can pivot counter to the action of supporting springs. The bridge is secured onto the top panel of the tachograph by insertion of a retainer.

13 Claims, 4 Drawing Sheets

TACHOGRAPH COMPRISING A CUBOID HOUSING AND A PRINTING DEVICE

This is a continuation of PCT/EP02/00433, filed Jan. 17, 2002.

BACKGROUND OF THE INVENTION

The present invention relates to a tachograph comprising a ciboid housing and a printing device. The printing device includes a thermal print head and a support which can be removed from the front side of the housing of the tachograph. Once removed it is possibile to reload a reel of paper or paper strip which forms the store of printing material. In addition, it is possible to reload a transport roll which, at least during printing, is operatively connected by a force fit to the thermal print head with the interposition of the printing material and is driven by a movement mechanism. The thermal print head is arranged in the housing of the tachograph and the transport roll and the movement mechanism are arranged in the support.

Tachographs which are not equipped for the use of circular graph charts as recording substrates but contain appropriately designed mass memories for the storage of the journey and working time data require printing devices which are suitable for documentation in the form of a visually legible record. The printing devices have to be arranged inside the tachograph since, in a driver's cab of a utility vehicle there is generally no free space for the installation of an independent printer in communication with the tachograph.

An advantage of electronic tachographs includes the flexibility of mounting location within the driver's cab. This advantage suffers when a printer is included with the electronic tachograph. Printers include certain requirements which limit tachograph location including the store of printing material and the necessity that the printing device be loaded with the store of printing material and for the starting section of the printing material to be brought into the printing position. This disadvantage is further exacerbated by the general design of tachographs themselves including a flat front face flush against a cab wall. Accordingly, only front loading of printer material is possible. To facilitate loading, it is necessary to use a support which can be displaced or pivoted out or folded out on the front side.

The structural concept mentioned in the beginning and described in German utility model DE-U 299 20 901.6 has the advantage of more beneficial utilization: of space than would be possible in the case of using commercially available printing units. In addition, in this design, threading the start of the paper strip between thermal print head and transport roll, and also precautions for eliminating a paper jam are dispensed with. Furthermore, the thermal print head can be fitted in a fixed location within the housing of the tachograph, so that even when the support is removed from the tachograph, immediate contact with dirt and moisture is largely avoided.

However, this assignment of the thermal print head to the housing causes problems inasmuch as the side walls and the top panel of the housing constitute relatively thin sheet metal parts. The installation space, for example, provided in a dashboard of a utility vehicle and corresponding to the format of the housing, does not permit any, outwardly projecting fixing elements. Further, reaction-free support of the spring-mounted thermal print head is necessary and seams and openings are to be avoided because of the intended tightness of the device. On the other hand, extremely little space is available for fitting the thermal print head in the direction of the vertical axis of the tachograph, and conditions of large-scale mass production have to be considered. This means that the fitting of the thermal print head is to be possible with the lowest possible expenditure on production and mounting and is to be easily reproducible with satisfactory functioning.

BRIEF SUMMARY OF THE INVENTION

The above disadvantages are addressed by the present invention which includes providing a stable arrangement of a thermal print head within the housing of a tachograph which is suitable for the aforementioned conditions, takes up little space, can be implemented with components which are as simple as possible, and can be mounted in a straightforward manner.

The invention provides for a support bridge which can be pivoted counter to the action of at least one spring. The support bridge is provided to support the thermal print head and is fixed to a top panel of the housing of the tachograph.

An exemplary embodiment is characterized in that a retainer that is fixed to the top panel is provided for fitting the support bridge to the top panel.

The exemplary embodiment is distinguished in particular by the fact that the retainer is plate-like, that lugs provided with through holes are formed on the legs of the support bridge, and in that platforms assigned to the lugs and prepared for screw connections are integrally molded on the retainer.

The retainer and the top panel are connected to each other seamlessly at a plurality of points by using a sheet metal forming technique. In addition, the retainer has a cutout corresponding to the support bridge. Likewise, the support bridge is fixed to the retainer in such a way that the support bridge engages in the cutout in the retainer. Further, the legs of the support bridge point away from the top panel.

An advantage of the present invention includes the thermal print head being be arranged exclusively on the top panel of the housing and thus, since no longitudinal or transverse beams for fitting the thermal print head are required within the housing, there is optimum utilization of the overall space provided. The present invention also permits secure and stable fixing of the thermal print head. In particular, the support fixing o f the thermal print head not only has to support the contact force on the transport roll but, when the support is displaced, also has to absorb force components oriented transversely with respect to the direction of action of the contact force. The support bridge serves as a mount, within the retainer, in such a way that the support bridge is fixed and braced by the top part of the housing thereby being locked in the direction of movement of the support. In addition, it should be emphasized that, because of the retainer being fixed over the largest possible area to the top part of the housing, the invention effects reinforcement which is expedient for the fitting of the thermal print head, and that the thermal print head can be replaced in a straightforward manner.

A method applied to fixing the retainer to the top part, which has been developed by Tox Pressotechnik GmbH and Co. KG, Weingarten, and is known as the Tox circular point sheet metal connecting method, provides a seamless connection in the manner of a press fastener by means of material forming. This connecting technique satisfies the requirement for tightness and flatness of the top part of its outer side.

The present invention comprises a tachograph, comprising: a housing comprising walls defining at least an internal cavity and a top panel, a printing device located within said cavity and comprising a thermal print head and printing material, a transport roll located within said cavity and functionally associated via a force fit to said head such that said printing material is positioned between said transport roll and said head, said transport roll driven by a movement mechanism, a support located within said cavity for supporting said printing device, printing material, transport roll and movement mechanism, said support comprising means for extending said printing device out of said housing, and a support bridge for supporting said thermal print head, said support bridge being pivotably responsive to a spring action, fixed to said top panel.

BRIEF DESCRIPTION OF THE SEVERAL VIEWS OF THE DRAWINGS

The novel features believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
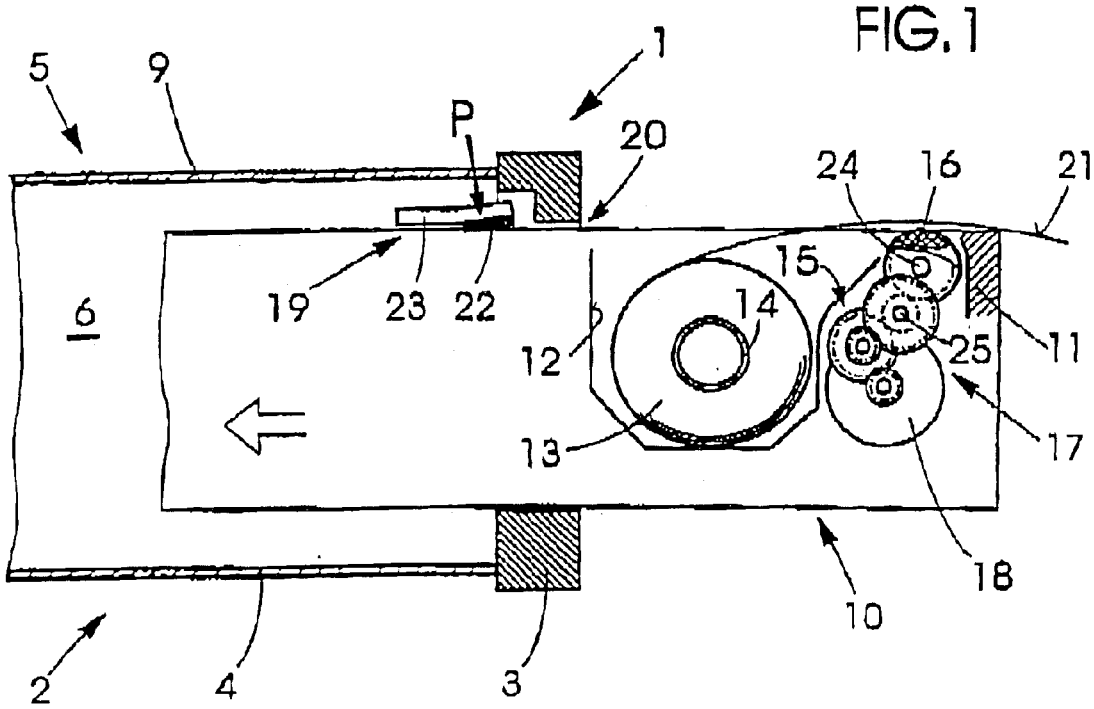
FIG. 1 depicts a side view of a printing device the support for which is formed as a drawer.

FIG. 1 depicts a tachograph 1 conceived as an installed device. The tachograph 1 includes a housing 2 which may be cuboid, include walls defining an internal cavity and a front wall 3. As further depicted, the space-saving housing 2, preferably produced from sheet metal material, comprises a top part 5, a bottom part 4, rear wall 8, side walls 6 and 7 (see FIG. 5) and top panel 9. The walls are appropriately connected so as to form the housing 2.

The front of tachograph 1 includes a display (not shown) which is, visible to the driver. The front further includes operating elements, slots and other means associated with data cards for the interactive use thereof.

The tachograph 1 further includes a printer subassembly with a support 10. The subassembly may be linearly extended and closed off in a drawer like manner. The subassembly may further be closed off by plate 11 which in the closed position is flush with at least front wall 3. The support 10 may be assigned a bistable latching mechanism which, in the event that printing material is to be topped up, may be unlocked and locked by operating plate 11. Operating plate 11 may comprise a pushbutton.

Figure 2:
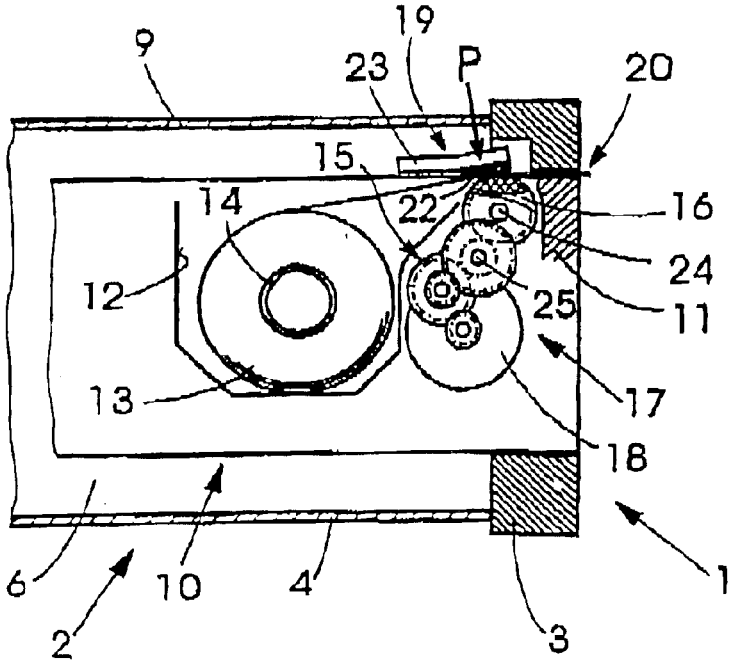
FIG. 2 depicts the printing device of FIG. 1 with the support pushed into the tachograph.

As further depicted in FIGS. 1 and 2, a holder 12 is formed in the support 10 and serves as a loose retainer for a reel of paper or paper strip 13 forming the store of printing material. The spool of the reel of paper strip 13 is designated 14. Between the holder 12 and the plate 11 of the support 10 there is an installation space 15, in which a transport roll 16 and a movement mechanism 17 driving the latter are mounted. 18 designates the motor of the movement mechanism 17.

A thermal print head 19 is assigned to housing 2. The print head is spring mounted (arrow P) when support 10 is inserted into the housing. The print head further includes a thermal element bar 22 and a heat sink 23. The paper reel 13, the movement mechanism 17, and the transport roll 16, are arranged in the displaceable support 10. It is therefore possible for the closing gap, existing between front wall 3 and plate 11, to serve as an output slot for starting section 21 of paper reel 13, after the paper reel has been inserted in holder 12. This is effected by the loose laying of starting section over the transport roll 16. Accordingly, the paper is clamped or accommodated in between roll 16 and print head 19. The shaft 24 of the transport roll 16 is expediently mounted such that it can be pivoted within a certain angle about the axis 25 of the movement mechanism 17, so that when the support 10 is pushed in, an alignment in relation to the thermal print head 19 which is independent of the guidance play of the support 10 is possible. It is likewise expedient to round off the front edge of the heat sink 23, facing the transport roll 16, in a suitable way.

Figures 3, 4:
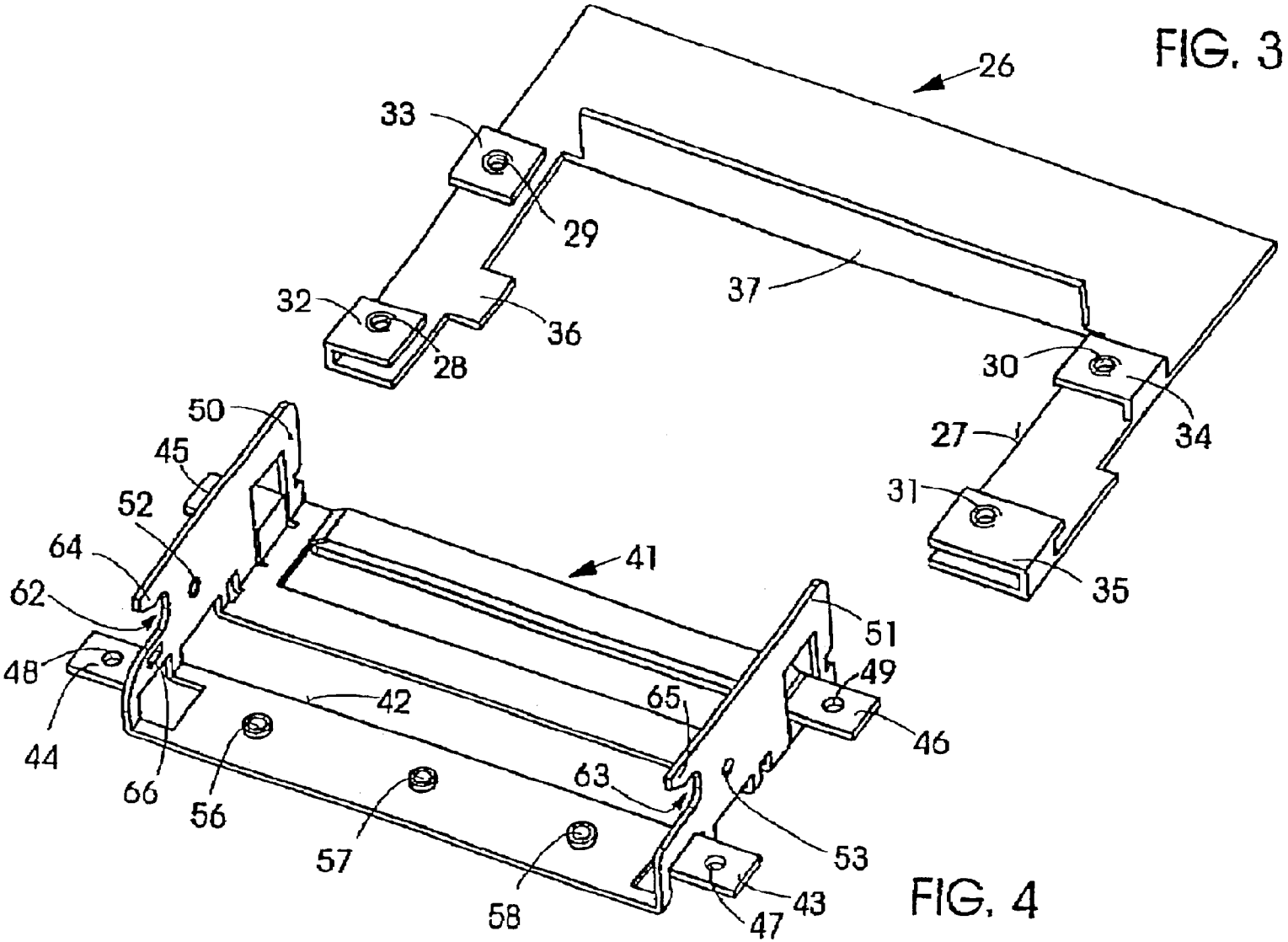
FIG. 3 depicts a prospective illustration of a retainer.
FIG. 4 depicts a support bridge serving to hold the thermal print head.
Figure 5:
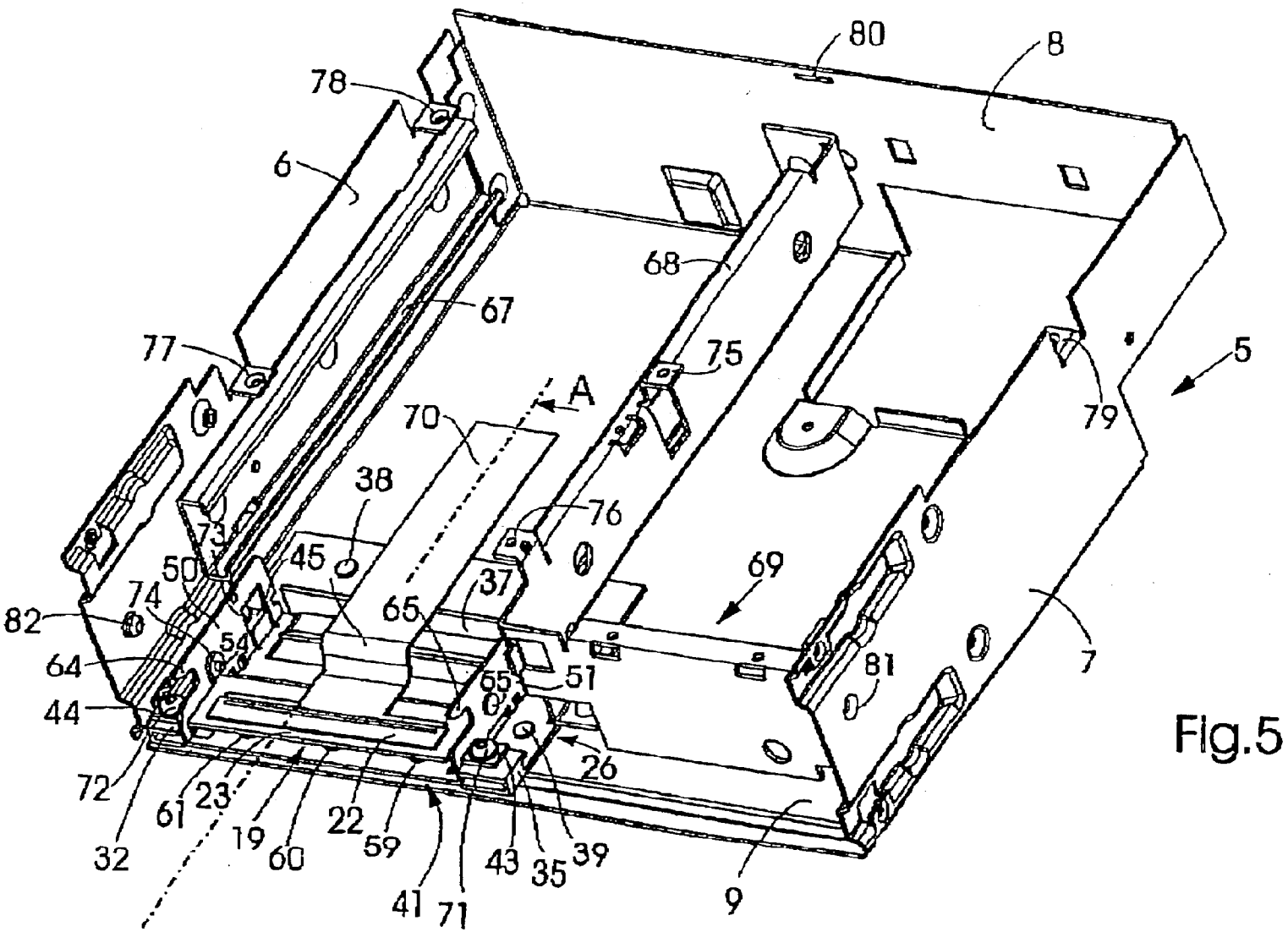
FIG. 5 depicts a perspective bottom view, illustrated as a plan view, of a top part of the housing with thermal print head installed.
Figure 6:
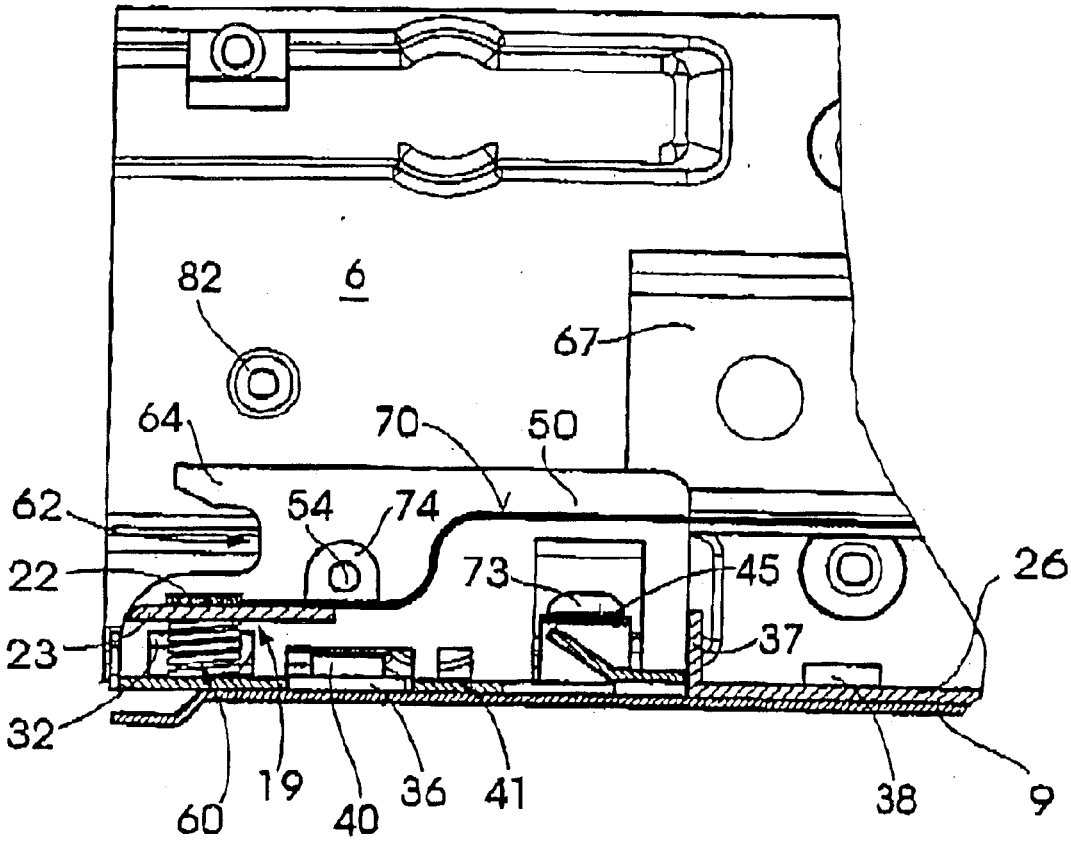
FIG. 6 depicts a partial section according to the section line A in FIG. 5.

For affixing the thermal print head 19 in the housing 2, a retainer 26, formed as a sheet metal part, is provided (see FIG. 3). On the substantially plate-like retainer 26, provided with a cutout 27, platforms 32, 33, 34 and 35 provided with threaded holes 28, 29, 30 and 31 are integrally molded, and at least one tongue 36 projecting into the cutout is formed. A stop bar 37 is assigned to the reel of paper strip 13. The retainer 26 is connected to the top panel 9 by means of the sheet metal connecting technique mentioned above of the elevations that are produced in the process, two are depicted in FIG. 5 and are designated 38 and 39. A third elevation 40 is illustrated in FIG. 6.

A support bridge 41 illustrated in FIG. 4 is formed in such a way that it can be inserted into the cutout 27 in the retainer 26 with, for example, little play. Here, the tongue 36 of the retainer 26 engages cutout 42 in the support bridge 41 and is therefore used to align the two components before they are screwed together. Lugs 43, 44, 45 and 46 are integrally molded on the support bridge 41 and provided with through holes 47, 48 and 49. Via the lugs, the support bridge 41 is fixed to the retainer 26.

Formed in the legs 50 and 51 of the support bridge 41 are holes 52 and 53, which are used to fit the bearing journals 54 and 55 (FIG. 5) assigned to the thermal print head 19. Indentations 56, 57 and 58 are provided to retain compression springs 59, 60 and 61 assigned to the thermal print head 19. Guide rails 64 and 65, on which the shaft 24 of the transport roll 16, loaded with the contact force of the thermal print head 19, is supported, are shaped by means of cutouts 62 and 63 provided in the legs 50, 51. At the front, the guide rails 64, 65 are provided with inclined surfaces (not shown) which make it easier to push shaft 24 onto guide rails 64, 65 at roughly the same time as the pivoting of thermal print head 19—itself subject to the compression action of springs 59, 60, 61. In this connection, shaft 21 is expediently assigned running bushes (not shown). An opening designated by 66 in the leg 50 is used by the thermal print head 19, which engages in the opening 66 with an integrally molded finger, as a limiting stop for the case in which the support 10 is removed from the tachograph 1.

As shown in FIG. 5, the support 10 is assigned running rails and 67 and 68 in the top part 5. One running rail 67 is fixed directly to the side wall 6 of the top part 5. Another running rail 68 is integrally molded on an L-shaped structural part 69 which reinforces the housing 2 and may provide fixing for the display of the tachograph 1. A flat ribbon cable 70 is assigned to the thermal print head 19. Of the screws serving to fix the support bridge 41 to the retainer 26, three 71, 72 and 73 are depicted in FIG. 5.

Support arms which interact with the bearing journals 54 and 55 are integrally molded on the thermal print head 19 or on its heat sink 23. One support arm 74 is depicted in FIGS. 5 and 6. With continued reference to FIG. 5, supports 75 and 76 are integrally molded on the structural part 69. Pads 77, 78 and 79 are formed on the side wall 6 and 7 and are provided in order to fix a printed circuit board carrying the electronic components of the tachograph 1. In addition, the pads 77, 78 and 79, together with a slot 80 in the rear wall 8, are used to fix the bottom part 4 to the top part 5, by bolts formed on the bottom part 4 being brought into engagement with the pads 77, 78, and 79 acting as tongues. Indentations 81 and 82 are provided to latch the front wall 3 to the housing 2.

FIG. 6 illustrates the direct and therefore space-saving assignment of the support bridge 41 to the top panel 9 of the top part 5, and the nesting of the detachable support bridge 41 in the non-detachable retainer 26. In this case, because of the stabilizing function, the retainer 26 should be connected to the top panel 9 over the greatest area possible.

The invention being thus described, it will be obvious that the same may be varied in many ways, Such variations may include a mixing of elements from the above embodiments. Such variations are not to be regarded as a departure from the spirit and scope of the invention, and all such modifications as would be obvious to one skilled in the art are intended to be included within the scope of the following claims.

I claim:

1. A tachograph, comprising:

a housing comprising walls defining at least an internal cavity and a top panel, a printing device located within said cavity and comprising a thermal print head and printing material, a transport roll located within said cavity and functionally associated via a force fit to said head such that said printing material is positioned between said transport roll and said head, said transport roll driven by a movement mechanism, a support located within said cavity for supporting said printing device, printing material, transport roll and movement mechanism, said support comprising means for extending said printing device out of said housing, and a support bridge for supporting said thermal print head, said support bridge being pivotably responsive to a spring action, fixed to said top panel.

2. The tachograph according to claim 1, further comprising a retainer, fixed to said top panel, said retainer facilitating fitting of said support bridge to said top panel.

3. The tachograph according to claim 2, wherein said retainer is plate-like and said support bridge comprises a plurality of legs.

4. The tachograph according to claim 3 further comprising a plurality of lugs formed on said legs and through holes, and a plurality of platforms assigned to said lugs and including means for screw connections integrally molded on said retainer.

5. The tachograph according to claim 2, wherein said retainer is longer and wider than a necessary area required by said screw connections for affixing said support bridge.

6. The tachograph according to claim 5, wherein said retainer comprises a cutout corresponding to said support bridge, and said support bridge is fixed to said retainer such that said support bridge engages said cutout and said legs point away from said top panel.

7. The tachograph according to claim 6, further comprising means for facilitating a form-fitting connection between and alignment of said retainer and said support bridge, and said means formed on said support bridge and on said retainer.

8. The tachograph according to claim 2, wherein said retainer and said top panel are connected to each other seamlessly and at a plurality of points.

9. The tachograph according to claim 1, further comprising guide rails and a transport roll having a shaft, said guide rails being assigned to said shaft and formed by means of cutouts in said legs.

10. The tachograph according to claim 9, further comprising inclined surfaces and bearing depressions assigned to said shaft and formed on said guide rails, said surfaces and depressions effecting a snap-in effect which is effective when opening and closing said support and in conjunction with said thermal print head acting in a sprung manner on said transport roll.

11. The tachograph according to claim 1, wherein said thermal print head further comprises a heat sink including a thermal element bar, said heat sink being mounted in said legs such that said heat sink can be pivoted radially with respect to said transport roll and assigned at least one stop limiting pivot.

12. The tachograph according to claim 1, wherein said housing is cuboid.

13. The tachograph according to claim 1, wherein said support bridge is pivotable in a direction counter to said spring action.

* * * * *